US007681488B2

(12) United States Patent
Wu

(10) Patent No.: US 7,681,488 B2
(45) Date of Patent: Mar. 23, 2010

(54) PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 1122 days.

(21) Appl. No.: 11/039,726

(22) Filed: Jan. 19, 2005

(65) Prior Publication Data

US 2006/0159575 A1 Jul. 20, 2006

(51) Int. Cl.
*F15B 15/26* (2006.01)
*F04B 39/00* (2006.01)

(52) U.S. Cl. ..... 92/58.1; 417/234

(58) Field of Classification Search ..... 92/58.1; 417/234, 572
See application file for complete search history.

(56) References Cited

U.S. PATENT DOCUMENTS 758,516 A * 4/1904 Fisher ..... 92/58.1
867,616 A 10/1907 Skinner ..... 417/258
2,462,980 A * 3/1949 Litt ..... 92/58.1
2,557,139 A * 6/1951 Peters et al. ..... 92/58.1
5,433,136 A 7/1995 Tsai ..... 92/58.1
5,551,848 A * 9/1996 Chuang et al. ..... 92/58.1
6,250,205 B1 * 6/2001 Chuang ..... 92/15
6,652,242 B2 11/2003 Wu ..... 417/63
6,736,619 B2 * 5/2004 Wu ..... 417/572
6,814,552 B2 * 11/2004 Wu ..... 417/440
7,404,703 B2 * 7/2008 Wang ..... 92/58.1

OTHER PUBLICATIONS

German Patent Publication No. DE 383731 C, Oct. 17, 1923, 5 pages.

* cited by examiner

*Primary Examiner*—Thomas E Lazo
(74) *Attorney, Agent, or Firm*—Alan Kamrath; Kamrath & Associates PA

(57) ABSTRACT

A pump includes a cylinder, a handle, a piston rod connected with the handle at an upper end and connected with a piston at a lower end, a flexible tube communicated with the cylinder, a nozzle communicated with the flexible tube, a first holding element installed on the cylinder in order to hold the flexible tube and a second holding element installed on one of the handle in order to hold the flexible tube.

4 Claims, 3 Drawing Sheets

PUMP

BACKGROUND OF INVENTION

1. Field of Invention

The present invention relates to a pump and, more particularly, to a pump with a flexible tube, a hook for hooking the flexible tube and a clip for clipping the tube.

2. Related Prior Art

Referring to FIG. 3, a conventional pump 1 includes a hollow base 4, a cylinder 5 communicated with the hollow base 4, a piston (not shown) movably installed in the cylinder 5, a clip 6 installed on the cylinder 5, a handle 2, a piston rod (not shown) including a lower end connected with the piston and an upper end connected with the handle 2, and a flexible tube 3 communicated with the hollow base 4. When not in use, the flexible tube 3 is hung on the handle 2 and clipped by the clip 6. The flexible tube 3 can easily slip from the handle 2 and get tangled. The flexible tube 3 hung on the handle 2 can cause an uncomfortable feeling for a user carrying the pump 1 by the handle 2.

The present invention is therefore intended to obviate or at least alleviate the problems encountered in the prior art.

SUMMARY OF INVENTION

According to the present invention, a pump includes a cylinder, a handle, a piston rod connected with the handle at an upper end and connected with a piston at a lower end, a flexible tube communicated with the cylinder, a nozzle communicated with the flexible tube, a first holding element installed on the cylinder in order to hold the flexible tube and a second holding element installed on the handle adjacent to the upper end of the piston rod in order to hold the flexible tube.

The primary advantage of the pump of the present invention is that the flexible tube is neatly and firmly held by the first and second holding elements when not in use.

Other advantages and novel features of the present invention will become more apparent from the following detailed description in conjunction with the drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
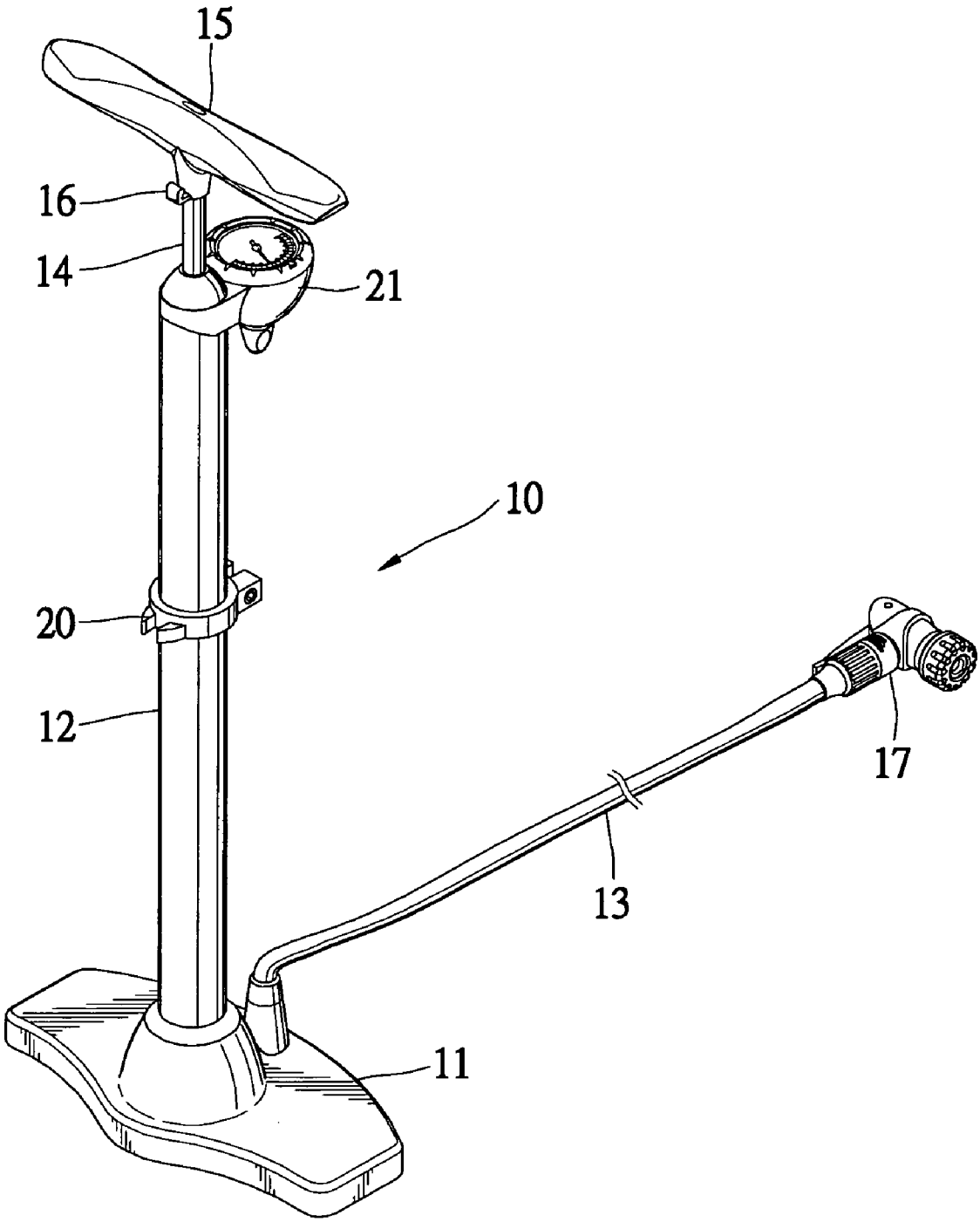
FIG. 1 is a perspective view of a pump including a flexible tube, a hook for hooking the flexible tube and a clip for clipping the flexible tube according to the preferred embodiment of the present invention.

Referring to FIG. 1, according to the preferred embodiment of the present invention, a pump 10 includes a hollow base 11, a cylinder 12, a piston (not shown), a piston rod 14, a handle 15, a flexible tube 13, a nozzle 17, a clip 20, a pressure gauge 21, and a hook 16.

In use, the hollow base 11 is generally installed on the ground or a floor and trodden by a user'legs. The cylinder 12 is communicated with the hollow base 12. The piston is movably installed in the cylinder 11. The piston rod 14 includes a lower end connected with the piston and an upper end connected with the handle 15. The flexible tube 13 is communicated with the hollow base 11 so that the flexible tube 13 is communicated with the cylinder 12 through the hollow base 11. The nozzle 17 is communicated with the flexible tube 13. In use, the nozzle 17 is engaged with a valve of an object to be pumped. The clip 20 is installed on the cylinder 11 in order to clip the flexible tube 13. The hook 16 is formed on the handle 15 near the piston rod 14 in order to hook the flexible tube 13.

Figure 2:
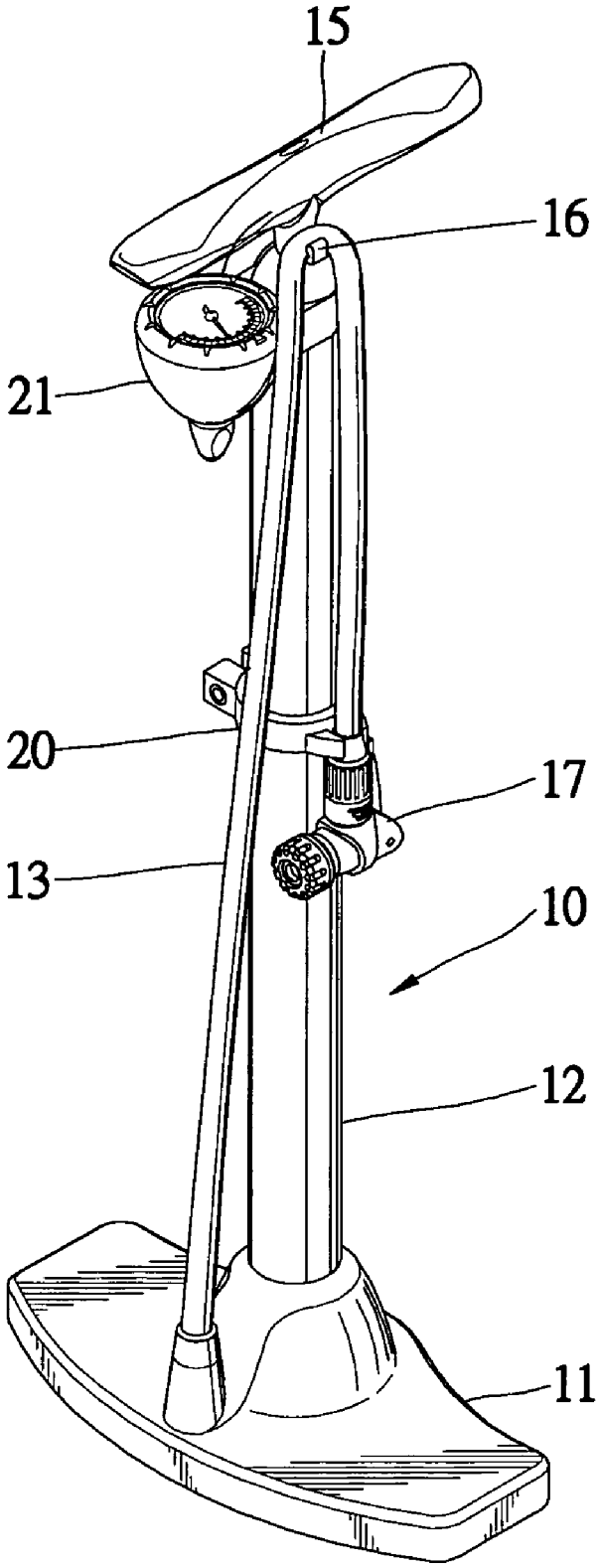
FIG. 2 is similar to FIG. 1 but shows the flexible tube hooked by the hook and clipped by the clip.
Figure 3:
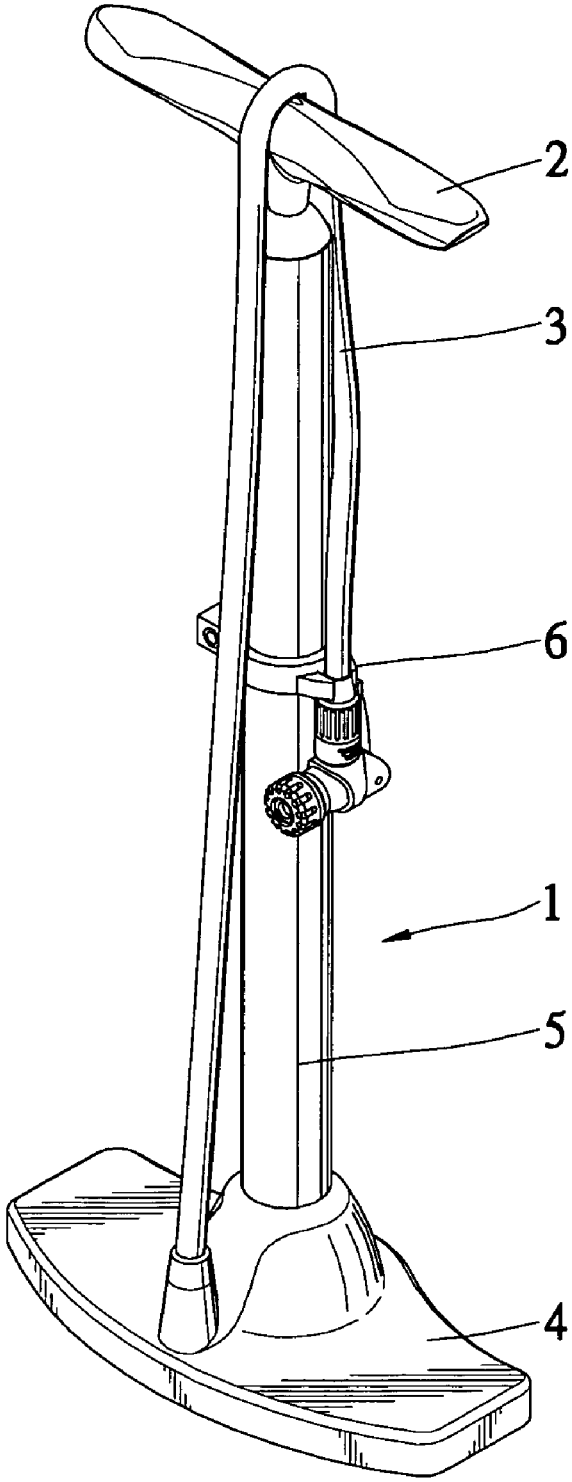
Fig. 3 PRIOR ART
FIG. 3 is a perspective view of a conventional pump.

Referring to FIG. 2, when not in use, the flexible tube 13 is hooked by the hook 16 and clipped by the clip 20. The flexible tube 13 cannot slip from the hook 16 and will not get tangled. The flexible tube 13, not hung on the handle 15, does not cause uncomfortable feeling for a user carrying the pump 10 by the handle 15.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A pump comprising:

a cylinder;

a handle;

a piston rod connected with the handle at an upper end and connected with a piston at a lower end, with the piston slideable in the cylinder, with the handle extending generally perpendicular to the piston rod, with the handle and the piston rod and the cylinder forming a generally T-shape, with the piston rod, handle and piston moveable from a not-in-use position, with the handle in the not-in-use position being adjacent to the cylinder and having increasing spacing from the cylinder when moved from the not-in-use position;

a flexible tube connected and in fluidal communication with the cylinder at a first end;

a nozzle communicated with the flexible tube opposite to the first end;

a first holding element installed on the cylinder; and a second holding element installed on the handle adjacent to the upper end of the piston rod, with the first holding element being spaced from and intermediate the first end of the flexible tube and the second holding element, with the flexible tube extending from the first end and over the second holding element, with the first holding element of a size slideably receiving the flexible tube adjacent to the nozzle, with the size of the first holding element preventing slideable passage of the nozzle, with the flexible hose being a length from the first end equal to a spacing of the second holding element from the first end plus a spacing of the second holding element from the first holding element when the handle is in the not-in-use position to hold the handle in the not-in-use position.

2. The pump according to claim 1 wherein the first holding element is a clip.

3. The pump according to claim 1 wherein the second holding element is a hook.

4. The pump according to claim 1 further comprising a hollow base though which the cylinder is communicated with the flexible tube.

* * * * *